United States Patent [19]

Hild

[11] 4,316,289

[45] Feb. 23, 1982

[54] SUN SHIELD FOR A HARD HAT

[76] Inventor: Melvin O. Hild, 923 W. 15th St., Grand Island, Nebr. 68801

[21] Appl. No.: 138,056

[22] Filed: Apr. 7, 1980

[51] Int. Cl.[3] ..... A42B 1/20; A42B 3/00

[52] U.S. Cl. ..... 2/191; 2/10; 2/422

[58] Field of Search ..... 2/191, 177, 10, 12, 2/422

[56] References Cited

U.S. PATENT DOCUMENTS 1,030,173 6/1912 Haggerty ..... 2/12 X
1,587,681 6/1926 Schumacher ..... 2/191
2,934,767 5/1960 Schoener ..... 2/10
3,409,908 11/1968 Simpson et al. ..... 2/10 X

FOREIGN PATENT DOCUMENTS 25101 10/1897 United Kingdom ..... 2/191

*Primary Examiner*—Peter P. Nerbun
*Attorney, Agent, or Firm*—Henderson & Sturm

[57] ABSTRACT

This invention relates to removable hat brims in general, and more specifically to a sunshield specifically designed to be used in the construction trades and adapted to frictionally and resiliently engage a hard hat to provide shade beyond that normally provided by the protective headgear.

4 Claims, 3 Drawing Figures

SUN SHIELD FOR A HARD HAT

BACKGROUND OF THE INVENTION

Sun shades for hats are well known in the prior art, as can be seen by reference to U.S. Pat. Nos. 65,871; 317,972; 819,324; 128,780 and 642,440. All of the references cited are characterized by the fact that they are intended for use with felt or other soft material hats, and are not designed for use with a protective headgear such as that required in the construction trades, when the workers are on site. With the exception of the Thratt patent, all of the prior art devices have employed a relative soft pliable material, which would not provide any sort of protection from falling objects.

In recent years, it has been generally accepted by both the medical field and the public generally that excessive and constant exposure to the ultra-violet rays of the sun greatly increase a person's chances of contracting skin cancer. Those working in the construction trade are often required to work long hours for days on end, or even an entire summer season with their heads largely exposed to such rays.

Since the extensive development of the western mountain areas for recreation such exposure is increasingly common in high elevations where the rays are more dangerous even during the winter months and doubly so due to snow and ice reflection. Since a construction tradesman is required to wear protective headgear against falling objects on such jobs, it follows that a sun shield which can be conveniently mounted and dismounted on such headgear, yet constructed so as to positively stay in place, fills a need not available among prior art devices.

The instant invention was developed specifically as an extension for a construction trademan's protective headgear, which is intended to not only provide protection from the direct rays of the sun, but also acts as a deflector of rain or other falling particles, such as might be encountered at a construction site.

The prior art devices are further characterized by the fact that they are either complex in assembly, are unsuited for the particular purposes envisioned due to the material from which they are constructed, or are bulky and occupy too much space for convenient and repeated use by the end user.

SUMMARY OF THE INVENTION

An object of the present invention is the provision of a sun shield for a hard hat which is very simple in its fabrication, yet provides an added measure of safety when it is employed by the user.

A further object of the instant invention is the provision of a rigid plastic auxiliary member for a construction worker's protective heargear, which will afford protection not only from the sun's rays but also from falling particles or moisture.

Still another object of the instant invention is the provision of a sun shield which is both frictionally and resiliently secured to a construction workers hard hat.

Yet another object of the instant invention is the provision of a piece of protective headgear which can be manufactured at a very low cost and in great quantities, and which further should receive wide acceptance in the construction trades, due to the benefits and added protection which will accrue to the user.

Another object of the instant invention is the provision of a sun shield for a hard hat, which is adapted to engage the external surfaces of the more commonly employed hard hats, the unique configuration of which, identifies the manufacturer of a given model.

These and other objects and advantages and novel features of the invention will become apparent from the following detailed description of the invention when considered in conjunction with the accompanying drawings.

DESCRIPTION OF THE PREFERRED EMBODIMENT

Figure 1:
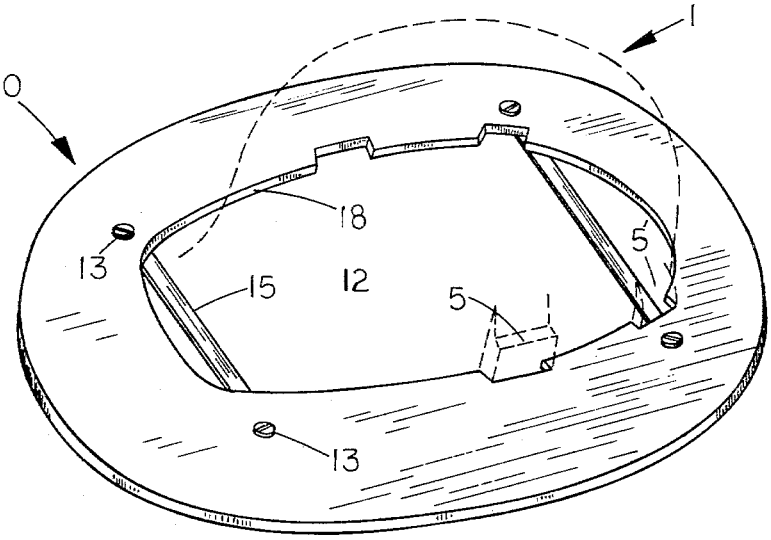
FIG. 1 is a perspective view of the instant invention as it would fit over a typical hard hat which is shown in phantom.
Figure 2:
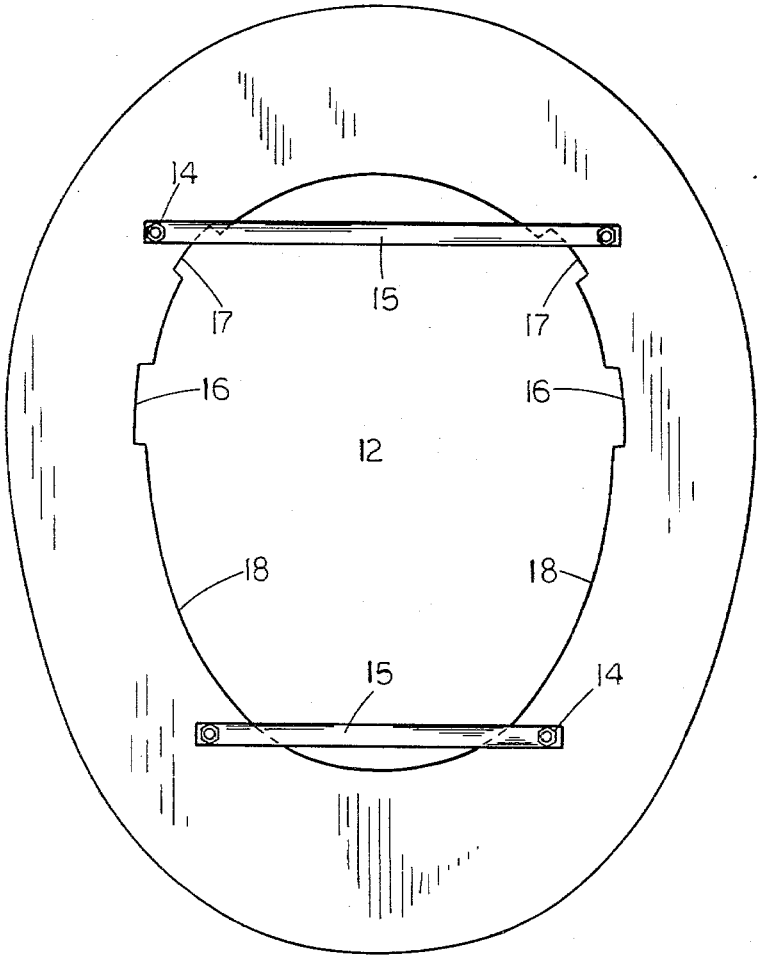
FIG. 2 is a bottom plan view of the hard hat sun shield showing the resilient fasteners, and the configuration of the central aperture to accommodate a given hard hat manufacturer's identifying external configuration.

FIG. 1 illustrates a preferred embodiment of the sun shield for a hard hat which is designated generally as 10, and which is adapted to cooperate with external surfaces of the hard hat, to provide protection not only from the rays of the sun but also from falling solid and liquid particles which are normally encountered at a construction site. The sun shield 10 comprises a relatively thick, generally oval piece of rigid plastic 11 which has an aperture 12 centrally disposed therein. The aperture 12 is generally oval in shape and is provided with a plurality of recesses 16 and 17 which are adapted to frictionally engage external projections 5 and 5' on a hard hat generally designated as 1 in FIG. 1. A plurality of small apertures are disposed around the oval sun shade element and are configured to receive securing means 13, which cooperate with fastening means 14 to suspend, support and attach resilient bands 15 which extend across the central aperture 12 at the forward and rearward end of the sun shield to resiliently attach the sun shield 11 to the hard hat 1.

As can best by seen by reference to FIG. 1 the aperture 12 is slipped over the top of the hard hat 1 and the resilient elements 15 are manually deformed to allow passage of the brim and the rearward portion of the hard hat to pass through the aperture 12. Upon release, the resilient elements 15 contact the underside of the hard hat at both the forward and rearward end. The resilient elements in their released state will also extend into the area, on the underside of the hard hat, which is normally occupied by a leather webbing (not shown), which is used to frictionally secure the hard hat upon the users head.

Figure 3:
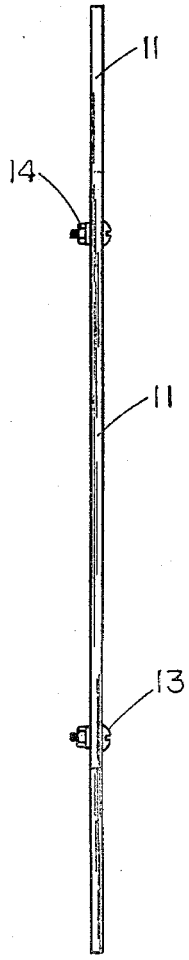
FIG. 3 is a side elevation of the hard hat sun shield showing the very small profile of the device, which makes this apparatus highly acceptable to the construction trades, in that it does not occupy a great deal of space during storage.

As can be seen by reference to FIG. 3 the sun shield has a very low profile, which essentially is the thickness of the sun shield material 11 plus the length of the securing means 13 and 14. This low profile is significant in that when the shield is not being used a plurality of shields can be stored in a relatively small space.

The shield itself is fabricated from a rigid, high impact, plastic material and the central aperture 12 is configured so that the recesses 16, 17 and the sides 18 surrounding the aperture 12 will frictionally engage the exterior configuration of a given hard hat. It should be obvious that there are several standard hat configurations, and that the central aperture 12 will have a variety of configurations which can be customized for any particular manufacturer of hard hats. The advantages of this particular construction are that it substantially increases the shade for the user during bright sunny days, will provide increased protection from rainfall, and will further extend the area of protection afforded by the hard hat itself in that it will deflect falling debris, due to the rigidity of the material employed.

Having thereby disclosed the subject matter of this invention it should be obvious that many modifications, substitutions and variations of the invention are possible in light of the above teachings. It is therefore to be understood that the invention may be practiced other than as specifically described and should be limited only by the breadth and scope of the appended claims.

I claim:

1. A sun shield adaptor to cooperate with protective headgear, such as hard hats, wherein the sun shield comprises:

a sheet of plastic of a rigidity and thickness sufficient to protect the wearer from falling particles and debris having a generally oval configuration extending said protection about all sides of the wearer's person; and a centrally disposed aperture having a plurality of recesses which frictionally engage external projections on a hard hat at the approximate intersection with the upper side of the hard hat's brim brim.

2. A sun shield adaptor to cooperate with protective headgear, such as hard hats, wherein the sun shield comprises:

a rigid thick sheet of plastic having a generally oval configuration;

a centrally disposed aperture having a plurality of recesses which will conform to, and frictionally engage the external surfaces of a hard hat; and a plurality of securing and fastening means which suspend, support and affix a plurality of resilient members to said sheet in such locations that said resilient members will engage the underside of the hard hat, without interfering with the wearing of said hat, when it is inserted through the centrally disposed aperture.

3. A sun shield as in claim 2 wherein:

the resilient means extends across the centrally disposed aperture into the area normally occupied by a leather webbing and no further, whereby the sun shield is more positively engaged to the underside of the hard hat.

4. A sun shield as in claim 3 wherein:

the plurality of recesses are dimensioned to frictionally engage protrusions on the external surfaces of a hard hat which is received within the aperture.

* * * * *